US009702312B2

(12) United States Patent
Andersson et al.

(10) Patent No.: US 9,702,312 B2
(45) Date of Patent: Jul. 11, 2017

(54) ENGINE CONTROL STRATEGY AND FEEDBACK SYSTEM

(71) Applicant: WALBRO ENGINE MANAGEMENT, L.L.C., Tucson, AZ (US)

(72) Inventors: Martin N. Andersson, Caro, MI (US); Mark S. Swanson, Cass City, MI (US)

(73) Assignee: Walbro LLC, Tucson, AZ (US)

( * ) Notice: Subject to any disclaimer, the term of this patent is extended or adjusted under 35 U.S.C. 154(b) by 44 days.

(21) Appl. No.: 14/773,993

(22) PCT Filed: Mar. 12, 2014

(86) PCT No.: PCT/US2014/024121

§ 371 (c)(1),
(2) Date: Sep. 9, 2015

(87) PCT Pub. No.: WO2014/150749

PCT Pub. Date: Sep. 25, 2014

(65) Prior Publication Data

US 2016/0032855 A1 Feb. 4, 2016

Related U.S. Application Data

(60) Provisional application No. 61/794,389, filed on Mar. 15, 2013.

(51) Int. Cl.
*F02D 41/14* (2006.01)
*F02D 35/00* (2006.01)
(Continued)

(52) U.S. Cl.
CPC ..... *F02D 41/1497* (2013.01); *F02D 35/0007* (2013.01); *F02B 25/00* (2013.01); *F02D 2200/101* (2013.01); *F02M 7/00* (2013.01)

(58) Field of Classification Search
CPC ..... F02D 41/1497; F02D 35/0007; F02D 2200/101; F02D 41/045; F02D 41/10; F02D 41/12; F02B 25/00; F02M 7/00
(Continued)

(56) References Cited

U.S. PATENT DOCUMENTS 5,345,912 A 9/1994 Svensson et al.
5,709,193 A * 1/1998 Svensson ..... F02D 31/007 123/333

(Continued)

FOREIGN PATENT DOCUMENTS

JP 2010164007 7/2010
KR 2019980051283 10/1998

OTHER PUBLICATIONS

Written Opinion & International Search Report for PCT/US2014/024121 dated Jul. 3, 2014, 12 pages.

(Continued)

*Primary Examiner* — Hai Huynh
(74) *Attorney, Agent, or Firm* — Reising Ethington P.C.

(57) ABSTRACT

In at least some implementations, an engine control process includes an engine speed test and other steps. The engine speed test includes the steps of a) determining a first engine speed, b) changing the air/fuel ratio of a fuel mixture delivered to the engine, and c) determining a second engine speed after at least some of the air/fuel ratio changing event, Based at least in part on the difference between the first engine speed and the second engine speed it is determined if a change in the air/fuel ratio of the fuel mixture delivered to the engine is needed. If a change to the air/fuel ratio was indicated, the air/fuel ratio of a fuel mixture delivered to the engine is changed.

30 Claims, 7 Drawing Sheets

(51) Int. Cl.
*F02M 7/00* (2006.01)
*F02B 25/00* (2006.01)

(58) Field of Classification Search
USPC ..... 701/101, 102, 103, 104, 109, 110, 114, 701/115; 123/436, 443, 492, 493
See application file for complete search history.

(56) References Cited

U.S. PATENT DOCUMENTS

| | | | | |
|---|---|---|---|---|
| 6,272,425 | B1 | 8/2001 | Herndon et al. | |
| 6,273,075 | B1 | 8/2001 | Choi et al. | |
| 7,000,595 | B2 | 2/2006 | Andersson et al. | |
| 2011/0191006 | A1* | 8/2011 | Nishida | F02D 41/0025 701/103 |
| 2011/0202258 | A1 | 8/2011 | Fukushima et al. | |
| 2016/0115879 | A1* | 4/2016 | Lehmen | F02D 41/1444 701/104 |

OTHER PUBLICATIONS

First Office Action in Corresponding Swedish Patent Application No. 1551274-2, dated Oct. 20, 2016, 5 pages.

* cited by examiner

ENGINE CONTROL STRATEGY AND FEEDBACK SYSTEM

REFERENCE TO CO-PENDING APPLICATION

This application claims the benefit of PCT/US2015/059376 application filed on Nov. 6, 2015; PCT/US2014/024121 application filed on Mar. 14, 2014; U.S. Provisional Application No. 62/075,945 filed on Nov. 6, 2014 and U.S. provisional Application No. 61/794,389 filed Mar. 15, 2013 each of which is incorporated herein by reference in its entirety.

TECHNICAL FIELD

The present disclosure relates generally to an engine feedback control strategy.

BACKGROUND

Combustion engines are provided with a fuel mixture that typically includes liquid fuel and air. The air/fuel ratio of the fuel mixture may be calibrated for a particular engine, but different operating characteristics such as type of fuel, altitude, condition of filters or other engine components, and differences among engines and other components in a production run may affect engine operation.

SUMMARY

In at least some implementations, an engine control process includes an engine speed test and other steps. The engine speed test includes the steps of a) determining a first engine speed, b) changing the air/fuel ratio of a fuel mixture delivered to the engine, and c) determining a second engine speed after at least some of the air/fuel ratio changing event. Based at least in part on the difference between the first engine speed and the second engine speed it is determined if a change in the air/fuel ratio of the fuel mixture delivered to the engine is needed. If a change to the air/fuel ratio was indicated, the air/fuel ratio of a fuel mixture delivered to the engine is changed.

In at least some implementations, an engine control process includes conducting an engine speed test that includes the steps of: a) determining a first engine speed, h) changing the air/fuel ratio of a fuel mixture delivered to the engine, and c) determining a second engine speed after at least some of the air/fuel ratio changing event. The process further includes providing to the engine a fuel mixture having a desired air/fuel ratio, where the desired air/fuel ratio is determined at least in part as a function of the difference between the first engine speed and the second engine speed.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
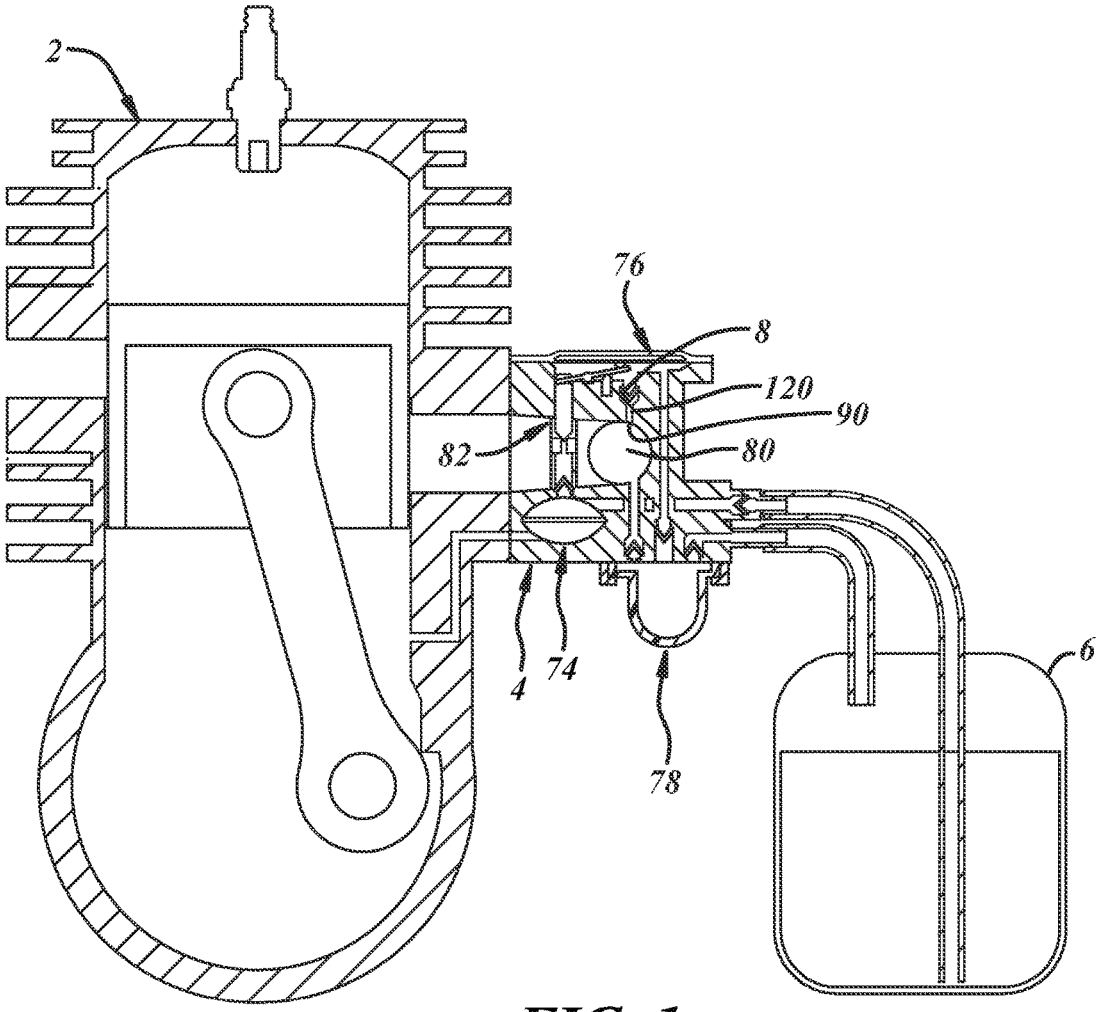
FIG. 1 is a schematic view of an engine and a carburetor including a fuel mixture control device.

Referring in more detail to the drawings. FIG. 1 illustrates an engine 2 and a charge forming device 4 that delivers a fuel and air mixture to the engine 2 to support engine operation. In at least one implementation, the charge forming device 4 includes a carburetor, and the carburetor may be of any suitable type including, for example, diaphragm and float bowl carburetors. A diaphragm-type carburetor 4 is shown in FIG. 1. The carburetor 4 takes in fuel from a fuel tank 6 and includes a mixture control device 8 capable of altering the air/fuel ratio of the mixture delivered from the carburetor. To determine a desired instantaneous air/fuel ratio, a comparison is made of the engine speed before and after the air/fuel ratio is altered. Based upon that comparison, the mixture control device 8 or some other component may be used to alter the fuel and air mixture to provide a desired air/fuel ratio.

Figure 2:
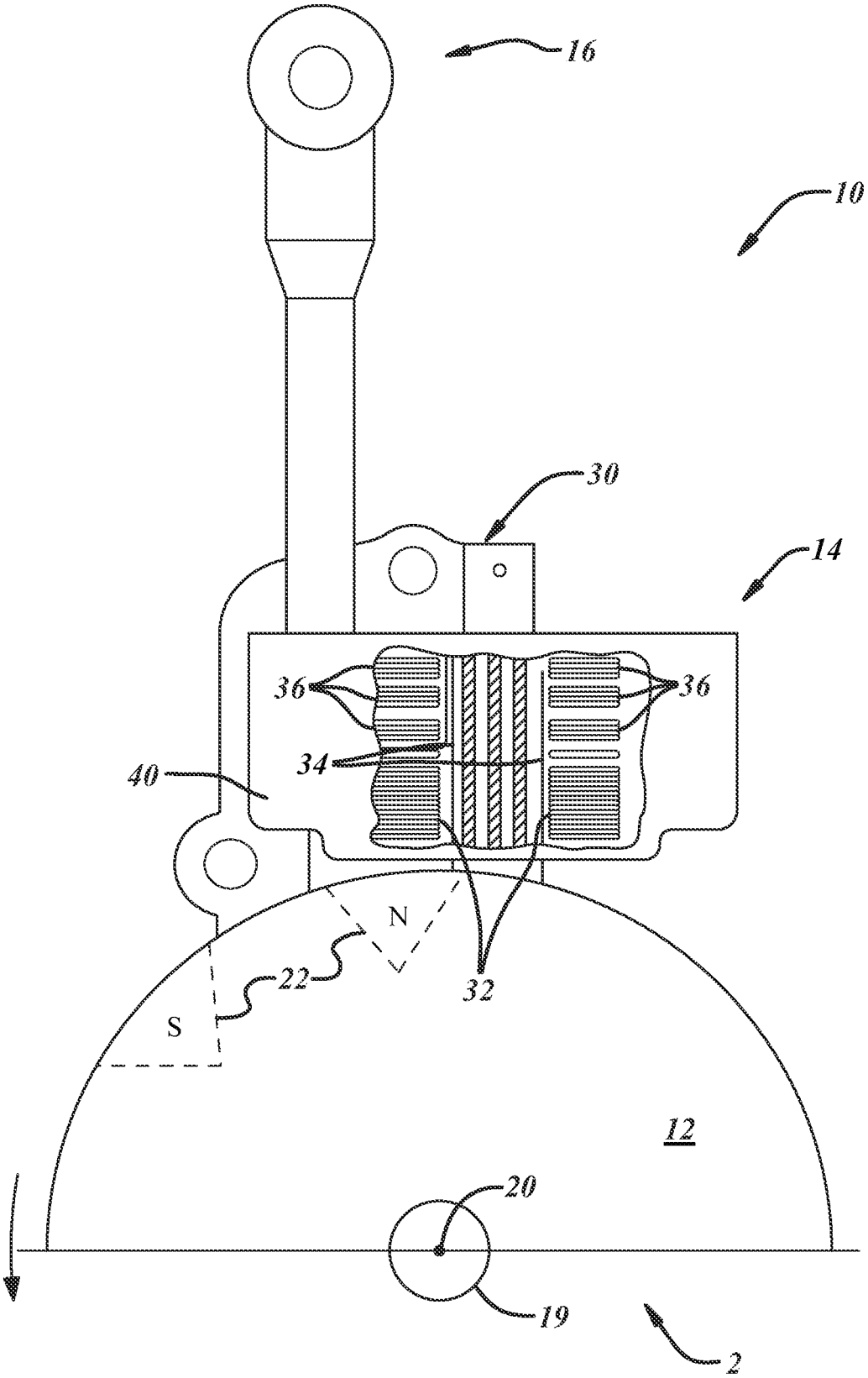
FIG. 2 is a fragmentary view of a flywheel and ignition components of the engine.
Figure 3:
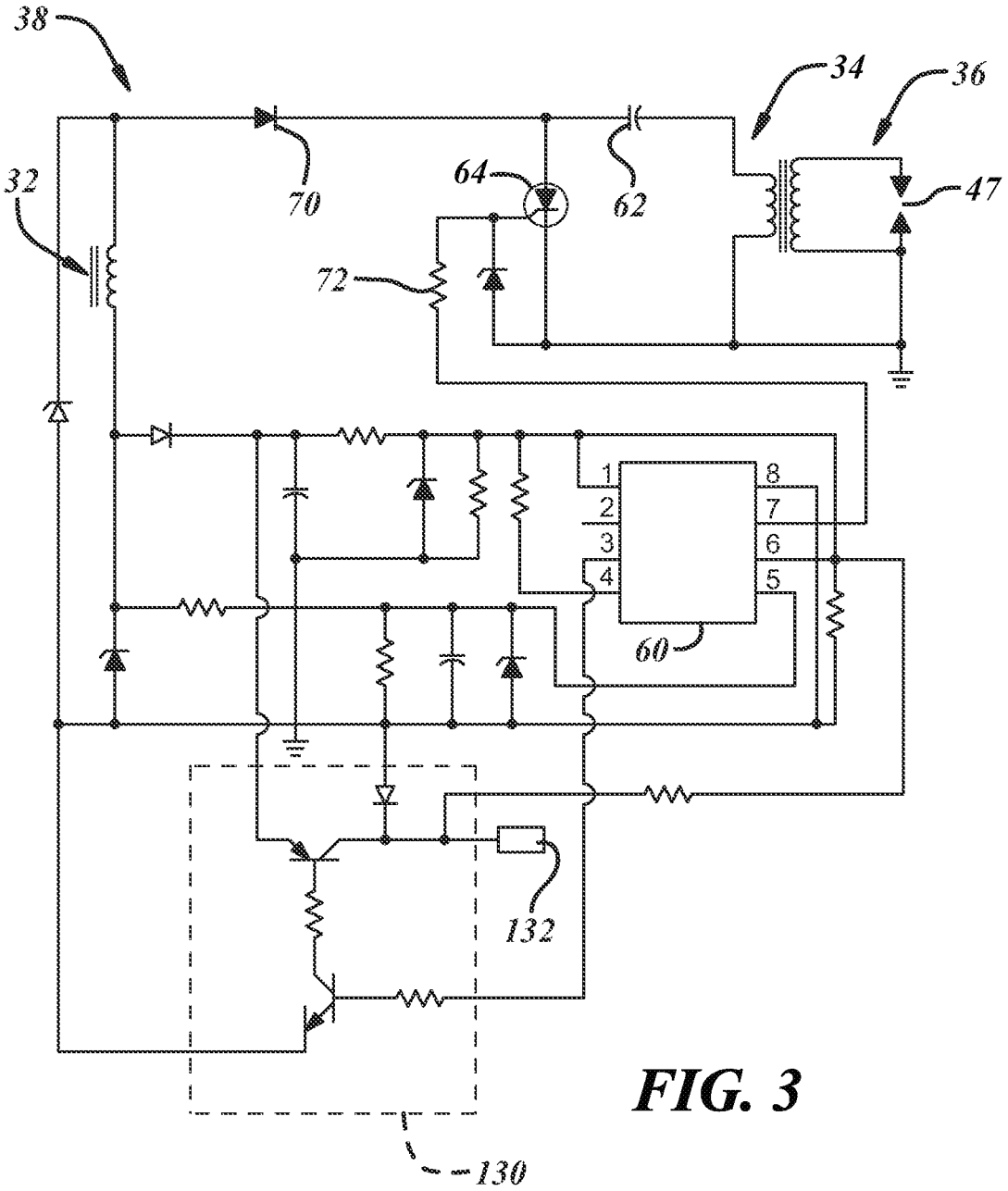
FIG. 3 is a schematic diagram of an ignition circuit.

The engine speed may be determined in a number of ways, one of which uses signals within an ignition system 10 such as may be generated by a magnet on a rotating flywheel 12. FIGS. 2 and 3 illustrates an exemplary signal generation or ignition system 10 for use with an internal combustion engine 2, such as (but not limited to) the type typically employed by hand-held and ground-supported lawn and garden equipment. Such equipment includes chainsaws, trimmers, lawn mowers, and the like. The ignition system 10 could be constructed according to one of numerous designs, including magneto or capacitive discharge designs, such that it interacts with an engine flywheel 12 and generally includes a control system 14, and an ignition boot 16 for connection to a spark plug (not shown).

The flywheel 12 rotates about an axis 20 under the power of the engine 2 and includes magnets or magnetic sections 22. As the flywheel 12 rotates, the magnetic sections 22 spin past and electromagnetically interact with components of the control system 14 for sensing engine speed among other things.

The control system 14 includes a ferromagnetic stator core or lamstack 30 having wound thereabout a charge winding 32, a primary ignition winding 34, and a secondary ignition winding 36. The primary and secondary windings 34, 36 basically define a step-up transformer or ignition coil used to fire a spark plug. The control system also includes a circuit 38 (shown in FIG. 3), and a housing 40, wherein the circuit 38 may be located remotely from the lamstack 30 and the various windings.

As the magnetic sections 22 are rotated past the lamstack 30, a magnetic field is introduced into the lamstack 30 that, in turn, induces a voltage in the various windings. For example, the rotating magnetic sections 22 induce a voltage signal in the charge winding 32 that is indicative of the number of revolutions of the engine 2 in the control system. The signal can be used to determine the rotational speed of the flywheel 12 and crankshaft 19 and, hence, the engine 2. Finally, the voltage induced in the charge winding 32 is also used to power the circuit 38 and charge an ignition discharge capacitor 62 in known manner. Upon receipt of a trigger signal, the capacitor 62 discharges through the primary winding 34 of the ignition coil to induce a stepped-up high voltage in the secondary winding 36 of the ignition coil that is sufficient to cause a spark across a spark gap of a spark plug 47 to ignite a fuel and air mixture within a combustion chamber of the engine.

In normal engine operation, downward movement of an engine piston during a power stroke drives a connecting rod (not shown) that, in turn, rotates the crankshaft 19, which rotates the flywheel 12. As the magnetic sections 22 rotate past the lamstack 30, a magnetic field is created which induces a voltage in the nearby charge winding 32 which is used for several purposes. First, the voltage may be used to provide power to the control system 14, including components of the circuit 38. Second, the induced voltage is used to charge the main discharge capacitor 62 that stores the energy until it is instructed to discharge, at which time the capacitor 62 discharges its stored energy across primary ignition winding 34. Lastly, the voltage induced in the charge winding 32 is used to produce an engine speed input signal, which is supplied to a microcontroller 60 of the circuit 38. This engine speed input signal can play a role in the operation of the ignition timing, as well as controlling an air/fuel ratio of a fuel mixture delivered to the engine, as set forth below.

Referring now primarily to FIG. 3, the control system 14 includes the circuit 38 as an example of the type of circuit that may be used to implement the ignition timing control system 14. However, many variations of this circuit 38 may alternatively be used without departing from the scope of the invention. The circuit 38 interacts with the charge winding 32, primary ignition winding 34, and preferably a kill switch 132, and generally comprises the microcontroller 60, an ignition discharge capacitor 62, and an ignition thyristor 64.

The microcontroller 60 as shown in FIG. 3 may be an 8-pin processor, which utilizes internal memory or can access other memory to store code as well as for variables and/or system operating instructions. Any other desired controllers, microcontrollers, or microprocessors may be used, however. Pin 1 of the microcontroller 60 is coupled to the charge winding 32 via a resistor and diode, such that an induced voltage in the charge winding 32 is rectified and supplies the microcontroller with power. Also, when a voltage is induced in the charge winding 32, as previously described, current passes through a diode 70 and charges the ignition discharge capacitor 62, assuming the ignition thyristor 64 is in a non-conductive state. The ignition discharge capacitor 62 holds the charge until the microcontroller 60 changes the state of the thyristor 64. Microcontroller pin 5 is coupled to the charge winding 32 and receives an electronic signal representative of the engine speed. The microcontroller uses this engine speed signal to select a particular operating sequence, the selection of which affects the desired spark timing. Pin 7 is coupled to the gate of the thyristor 64 via, a resistor 72 and transmits from the microcontroller 60 an ignition signal which controls the state of the thyristor 64. When the ignition signal on pin 7 is low, the thyristor 64 is nonconductive and the capacitor 62 is allowed to charge. When the ignition signal is high, the thyristor 64 is conductive and the capacitor 62 discharges through the primary winding 34, thus causing an ignition pulse to be induced in the secondary winding 36 and sent on to the spark plug 47. Thus, the microcontroller 60 governs the discharge of the capacitor 62 by controlling the conductive state of the thyristor 64. Lastly, pin 8 provides the microcontroller 60 with a ground reference.

To summarize the operation of the circuit, the charge winding 32 experiences an induced voltage that charges ignition discharge capacitor 62, and provides the microcontroller 60 with power and an engine speed signal. The microcontroller 60 outputs an ignition signal on pin 7, according to the calculated ignition timing, which turns on the thyristor 64. Once the thyristor 64 is conductive, a current path through the thyristor 64 and the primary winding 34 is formed for the charge stored in the capacitor 62. The current discharged through the primary winding 34 induces a high voltage ignition pulse in the secondary winding 36. This high voltage pulse is then delivered to the spark plug 47 where it arcs across the spark gap thereof, thus igniting an air-fuel charge in the combustion chamber to initiate the combustion process.

As noted above, the microcontroller 60, or another controller, may play a role in altering an air/fuel ratio of a fuel mixture delivered by a carburetor 4 (for example) to the engine 2. In the embodiment of FIG. 1, the carburetor 4 is a diaphragm type carburetor with a diaphragm fuel pump assembly 74, a diaphragm fuel metering assembly 76, and a purge/prime assembly 78, the general construction and function of each of which is well-known. The carburetor 4 includes a fuel and air mixing passage 80 that receives air at an inlet end and fuel through a fuel circuit 82 supplied with fuel front the fuel metering assembly 76. The fuel circuit 82 includes one or more passages, port and/or chambers formed in a carburetor main body. One example of a carburetor of this type is disclosed in U.S. Pat. No. 7,467,785, the disclosure of which is incorporated herein by reference in its entirety. The mixture control device 8 is operable to alter the flow of fuel in at least part of the fuel circuit to alter the air/fuel ratio of a fuel mixture delivered from the carburetor 4 to the engine to support engine operation as commanded by a throttle.

Figure 5:
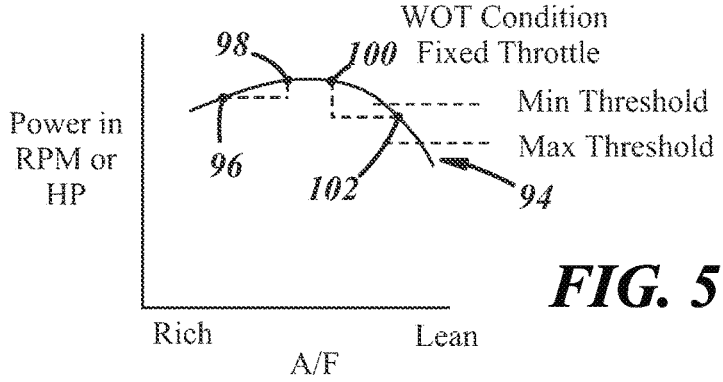
FIG. 5 is a graph of a representative engine power curve.

For a given throttle position, the power output for an engine will vary as a function of the air/fuel ratio. A representative engine power curve 94 is shown in FIG. 5 as a function of air/fuel ratio, where the air/fuel ratio becomes leaner from left-to-right on the graph. This curve 94 shows that the slope of the curve on the rich side is notably less than the slope of the curve on the lean side. Hence, when a richer fuel mixture is enleaned the engine speed will generally increase by a lesser amount than when a leaner fuel mixture is enleaned by the same amount. This is shown in FIG. 5, where the amount of enleanment between points 96 and 98 is the same as between points 100 and 102, yet the engine speed difference is greater between points 100 and 102 than it is between points 96 and 98. In this example, points 96 and 98 are richer than a fuel mixture that corresponds to engine peak power output, while point 100 corresponds to a fuel mixture that provides engine peak power output and point 102 is leaner than all of the other points.

Figure 4:
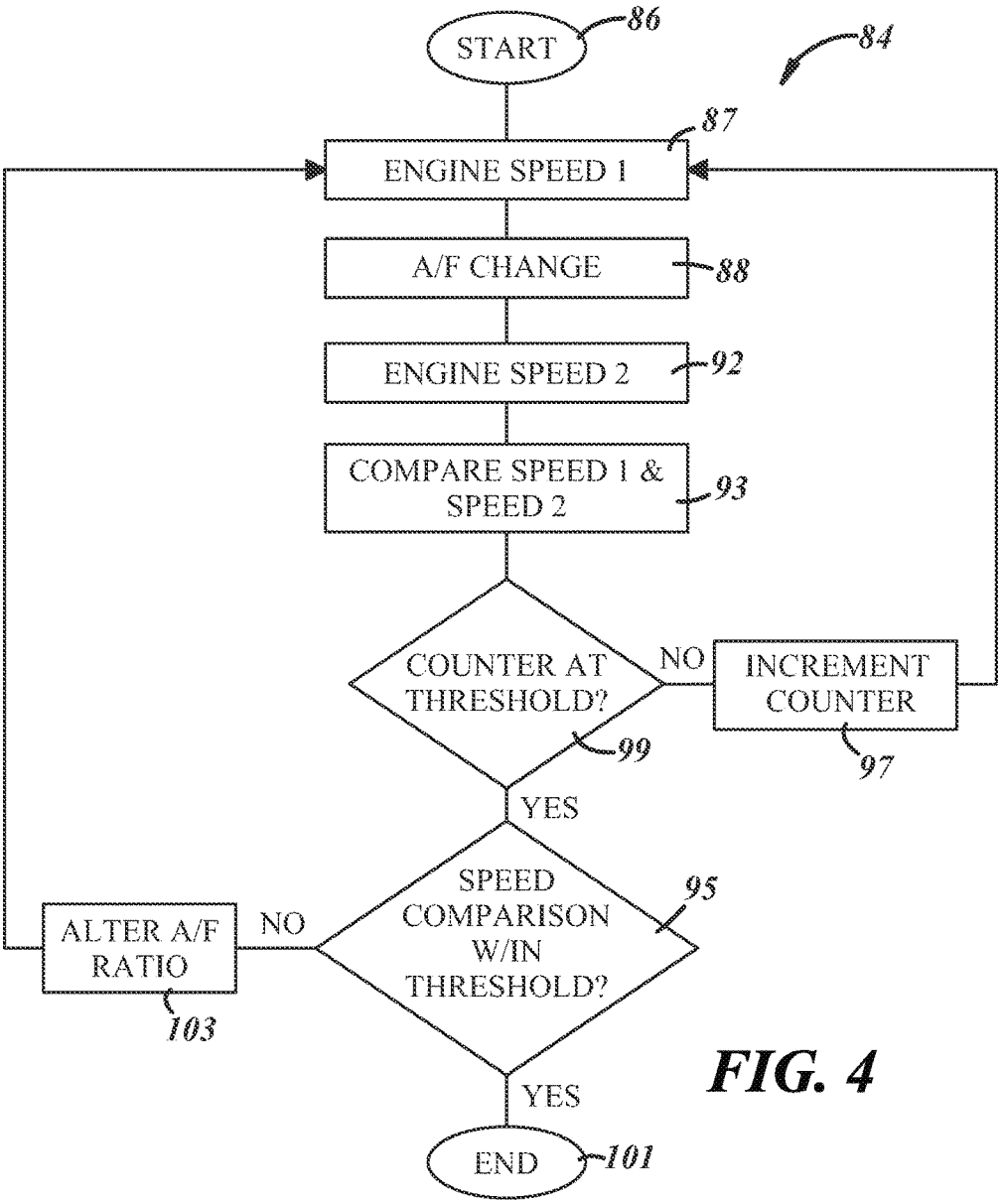
FIG. 4 is a flowchart for an engine control process.

The characteristics of the engine power curve 94 may be used in an engine control process 84 that determines a desired air/fuel ratio for a fuel mixture delivered to the engine. One example of an engine control process 84 is shown in FIG. 4 and includes an engine speed test wherein engine speed is determined as a function of a change in the air/fuel ratio of the fuel mixture, and an analysis portion where data from the engine speed test is used to determine or confirm a desired air/fuel ratio of the fuel mixture.

The engine control process 84 begins at 86 and includes one or more engine speed tests. Each engine speed test may essentially include three steps. The steps include measuring engine speed at 87, changing the air/fuel ratio of the fuel mixture provided to the engine at 88, and then measuring the engine speed again at 92 after at least a portion of the air/fuel ratio change has occurred.

The first step is to measure the current engine speed before the fuel mixture is enleaned. Engine speed may be determined by the microcontroller 60 as noted above, or in any other suitable way. This is accomplished, in one implementation, by measuring three engine speed parameters with the first being the cyclic engine speed. This is the time difference for one revolution of the engine. In most engines, there is a large amount of repeatable cyclic engine speed variation along with a significant amount of non-repeatable cyclic engine speed variation. This can be seen in FIG. 6, where the cyclic engine speed is shown at 104. Because this cyclic variability is difficult to use in further determinations, a rolling average (called F1-XX) is created, where XX is the number of revolutions being averaged, and generally F1 is a low averaging value such as 4 or 6. This greatly eliminates the large repeatable cyclic engine speed variation but does not dampen out too much the non-repeatable cyclic engine speed variation. The third engine speed value is F2-XX, and F2 is a greater averaging value, such as 80 revolutions. This amount of averaging greatly dampens out any variations of speed change and the intent is to dampen out the effect of the enleanment engine speed change. Now that there are two usable rpm values, F1-6 and F2-80 in this example, the difference of these values can be used to represent the engine speed change caused by the enleanment of the fuel mixture during an engine speed test.

In addition to measuring engine speed, the engine speed test includes changing the air/fuel ratio of the fuel mixture delivered to the engine. This may be accomplished with the mixture control device, e.g. solenoid valve 8 may be actuated thereby changing an air/fuel ratio of a mixture delivered to the engine 2 from the carburetor 4. In at least some implementations, the solenoid valve 8 may be actuated to its closed position to reduce fuel flow to a main fuel port or jet 90, thereby enleaning the fuel and air mixture. The valve 8 may be closed for a specific time period, or a duration dependent upon an operational parameter, such as engine speed. In one form, the valve 8 is closed (or nearly closed) for a certain number or range of engine revolutions, such as 1 to 150 revolutions. This defines an enleanment period wherein the leaner fuel and air mixture is delivered to the engine 2. Near, at or just after the end of the enleanment period, the engine speed is again determined at 92 as noted above.

Figure 6:
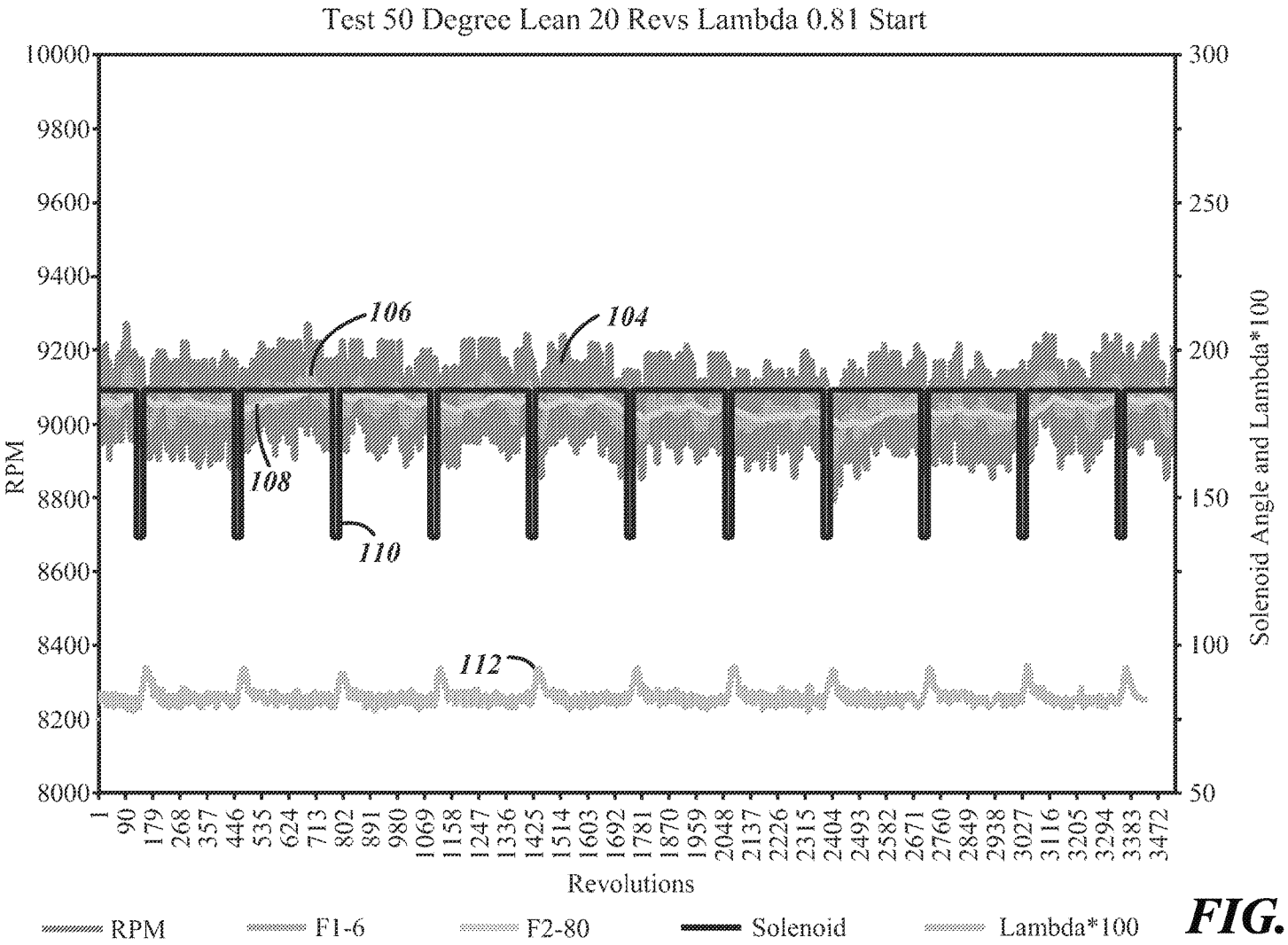
FIGS. 6-8 are graphs showing several variables that may be tracked during an engine speed test.
Figure 7:
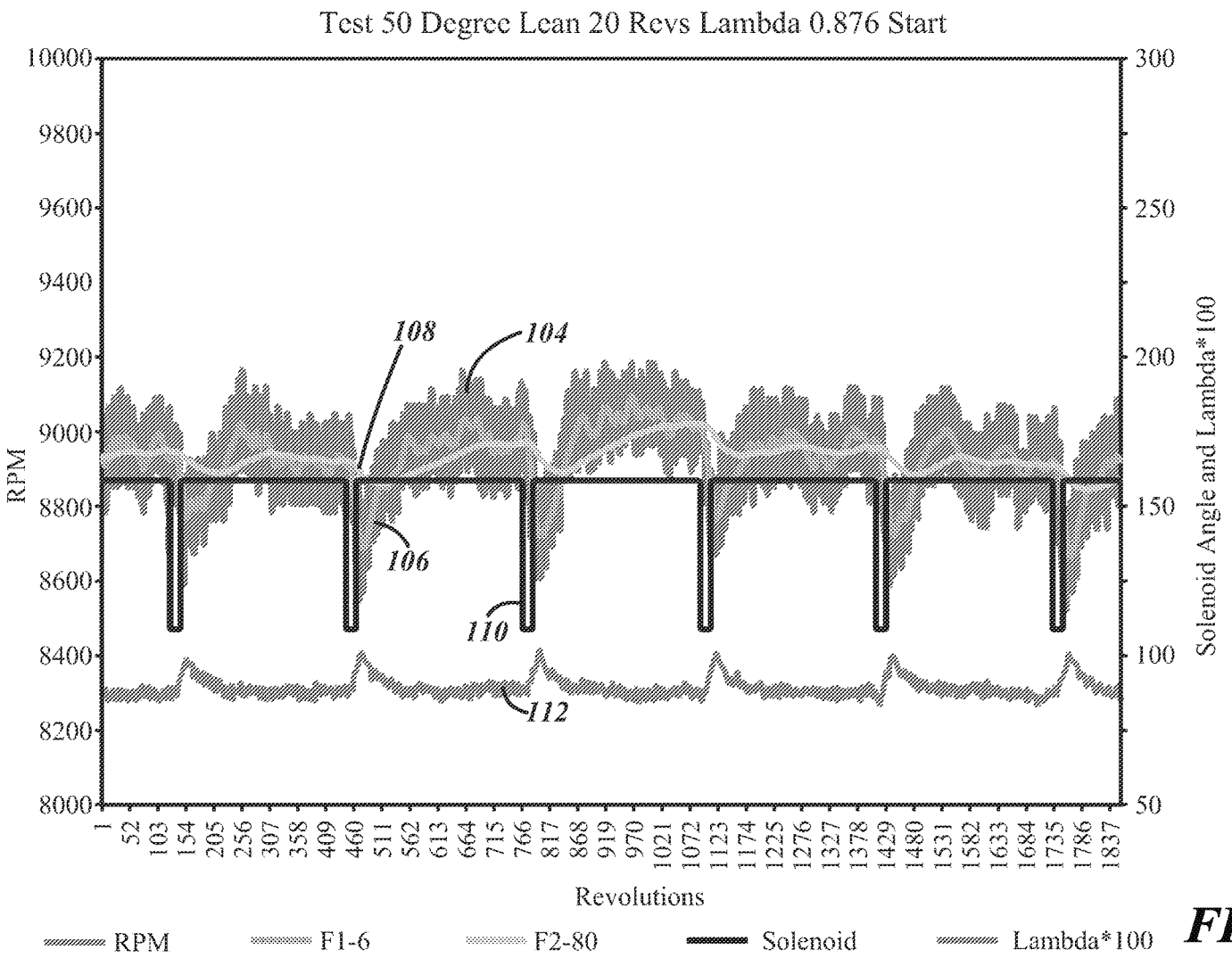
Figure 8:
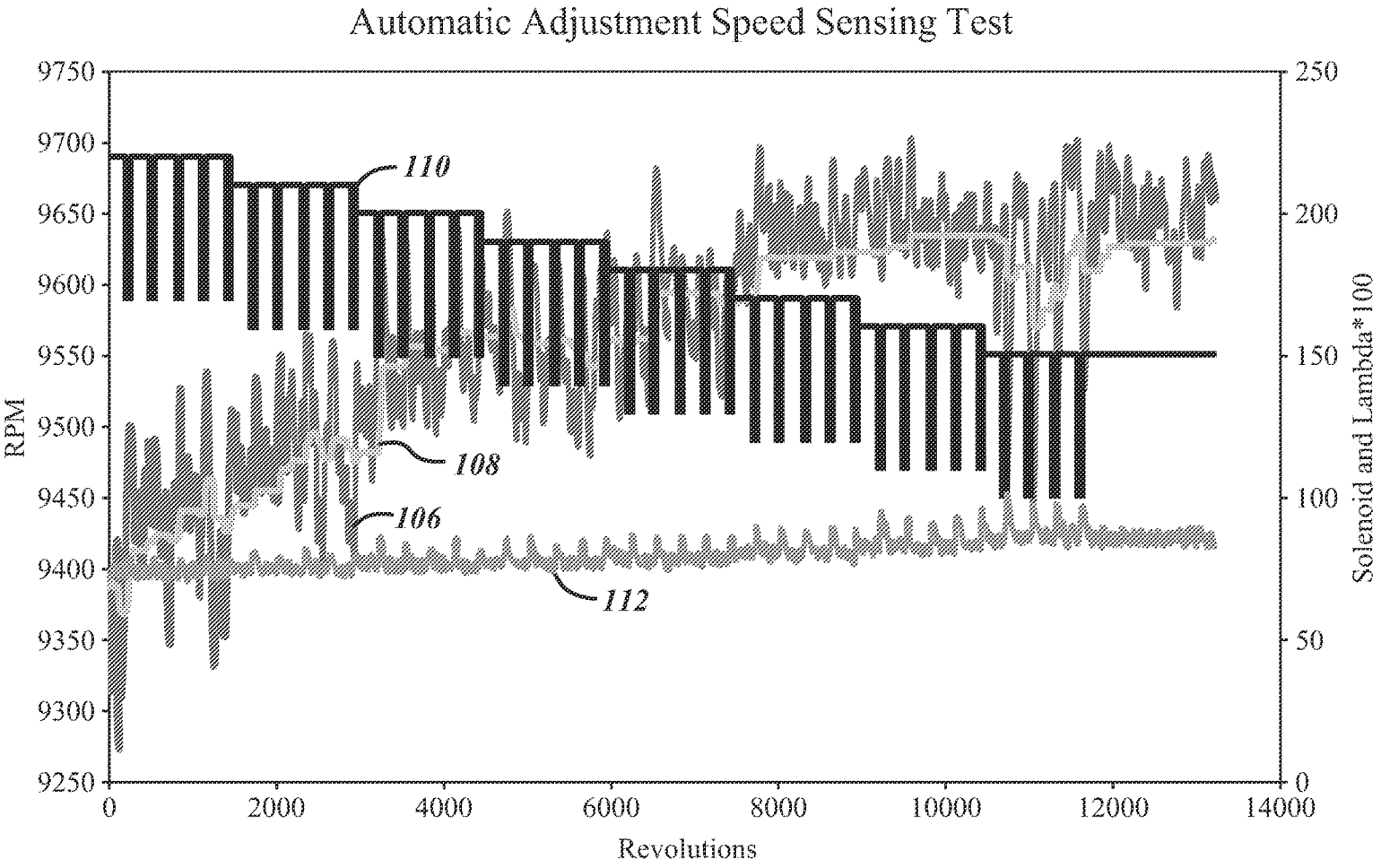

FIGS. 6-8 show engine speed (in rpm) versus number of engine revolutions during one or more engine speed tests. F1-6 is shown by line 106, F2-80 is shown by line 108, the solenoid actuation signal is shown by line 110, and a fuel/air ratio (Lambda) is shown by line 112.

FIG. 6 shows the initial air/fuel ratio to be rich at Lambda=0.81. The amount of enleanment in the example test was 50 degrees for 20 revolutions. This means that the solenoid valve was actuated 50 degrees earlier in the engine stroke than it would have been for normal engine operation (e.g. operation other than during the test). The increased duration of solenoid actuation leads to an enleaned fuel mixture. From this enleanment, the average rpm difference of F1-6 and F2-80 is 30 rpm. Because the enleanment is so large, 50 degrees, a decrease of 30 rpm is observed even though the initial air/fuel ratio is still 6% richer than a fuel mixture ratio that would yield peak engine power.

FIG. 7 shows the same 50 degree enleanment test for 20 revolutions but the starting air/fuel ratio is at Lambda=0.876 which approximately corresponds to peak engine power. The average engine speed difference between F1-6 and F2-80 in this example is 148 rpm, approximately five times greater than the speed difference from a starting air/fuel ration of Lambda=0.81.

Because the process as described involves enleaning a fuel mixture, the initial or calibrated air/fuel ratio should be richer than desired. This ensures that at least some enleanment will lead to a desired air/fuel ratio. In at least some implementations, the initial air/fuel ratio may be up to about 30% richer than the fuel mixture corresponding to peak engine power. Instead of or in addition to Meaning, enriching the fuel mixture may be possible in a given carburetor construction, and in that case the engine speed test could include an enriching step if an unduly lean air/fuel ratio where determined to exist. Enriching may be done, for example, by causing additional fuel to be supplied to the engine, or by reducing air flow. The process may be simpler by starting with a richer fuel mixture and enleaning it, as noted herein.

Referring again to the engine control process shown in FIG. 4, the two engine speed measurements obtained at 87 and 92 are compared at 93. To improve the accuracy of the engine control process, several engine speed tests may be performed, with a counter incremented at 97 after each engine speed test, and the counter compared to a threshold at 99 to determine if a desired number of engine speed tests have been performed. If a desired number of tests have been performed, the process 84 then analyzes the data from the engine speed test(s).

To determine whether the fuel mixture delivered to the engine before the engine speed tests were performed was within a desired range of air/fuel ratios, the engine speed differences determined at 93 are compared against one or more thresholds at 95. Minimum and maximum threshold values may be used for the engine speed difference that occurs as a result of enleaning the fuel mixture provided to the engine. An engine speed difference that is below the minimum threshold (which could be a certain number of rpm's) likely indicates that the air/fuel ratio before that enleanment was richer than a mixture corresponding to peak engine power. Conversely, an engine speed difference that is above the maximum threshold (which could be a certain number of rpm's) indicates that the air/fuel ratio became too lean (indicating the fuel mixture started leaner than a peak power fuel mixture, as noted above). In at least some implementations, the minimum threshold is 15 rpm, and the maximum threshold is 500 rpm or higher. These values are intended to be illustrative and not limiting—different engines and conditions may permit use of different thresholds.

In the process 84 shown in FIG. 4, the engine speed test is performed multiple times in a single iteration of the process 84. In one iteration of the process 84, it is determined at 95 if the engine speed difference of any one or more of the engine speed tests is within the threshold values, and if so, the process may end at 101. That is, if a threshold number (one or more) of the determined engine speed differences from 93 are within the thresholds, the process may end because the starting air/fuel ratio (e.g. the air/fuel ratio of the mixture prior to the first engine speed test of that process iteration) is at or within an acceptable range of a desired air/fuel ratio. In one implementation, five engine speed tests may be performed, and an engine speed difference within the thresholds may be required from at least three of the five engine speed tests. Of course, any number of engine speed tests may be performed (including only one) and any number of results within the thresholds may be required (including only one and up to the number of engine speed tests performed).

If a threshold number of engine speed differences (determined at 93) are not within the thresholds, the air/fuel ratio of the mixture may be altered at 103 to a new air/fuel ratio and the engine speed tests repeated using the new air/fuel ratio. At 95, if an undesired number of engine speed differences were less than the minimum threshold, the air/fuel ratio of the fuel mixture may be enleaned at 103 before the engine speed tests are repeated. This is because an engine speed difference less than the minimum threshold indicates the fuel mixture at 87 was too rich. Hence, the new air fuel ratio from 103 is leaner than when the prior engine speed tests were performed. This can be repeated until a threshold number of engine speed differences are within the thresholds, which indicates that the fuel mixture provided to the engine before the engine speed tests were conducted (e.g. at 87) is a desired air/fuel ratio. Likewise, at 95, if an undesired number of engine speed differences were greater than the maximum threshold, the air/fuel ratio of the fuel mixture may be enriched, at 103 before the engine speed tests are repeated. This is because an engine speed difference greater than the maximum threshold indicates the fuel mixture at 87 was too lean. Hence, the new air fuel ratio from 103, in this instance, is richer than when the prior engine speed tests were performed. This also can be repeated until a threshold number of engine speed differences are within the thresholds, with a different starting air/fuel ratio for each iteration of the process.

When a desired number of satisfactory engine speed differences (i.e. between the thresholds) occur at a given air/fuel ratio, that air/fuel ratio may be maintained for further operation of the engine. That is, the solenoid valve 8 may be actuated during normal engine operation generally in the same manner it was for the engine speed tests that provided the satisfactory results.

FIG. 8 shows a fuel mixture adjustment test series starting from a rich air/fuel ratio of about Lambda=0.7, and ending with an air/fuel ratio of about Lambda=0.855. In this series, the enleanment step was repeated several times until a desired number of engine speed differences within the thresholds occurred. That resulted in a chosen air/fuel ratio of about Lambda=0.855, and the engine may thereafter be operated with a fuel mixture at or nearly at that value for improved engine performance by control of the solenoid valve 8 or other mixture control device(s).

As noted above, instead of trying to find an engine speed difference (after changing the air/fuel ratio) that is as small as possible to indicate the engine peak power fuel mixture, the process may look for a relatively large engine speed difference, which may be greater than a minimum threshold. This may be beneficial because it can sometimes be difficult to determine a small engine speed difference during real world engine usage, when the engine is under load and the load may vary during the air/fuel ratio testing process. For example, the engine may be used with a tool used to cut grass (e.g. weed trimmer) or wood (e.g. chainsaw). Of course, the engine could be used in a wide range of applications. By using a larger speed difference in the process, the "noise" of the real world engine load conditions have less of an impact on the results. In addition, as noted above, there can be significant variances in cyclic speed during normal operation of at least some small engines making determination of smaller engine speed differences very difficult.

As noted above, the engine load may change as a tool or device powered by the engine is in use. Such engine operating changes may occur while the engine speed test is being conducted. To facilitate determining if an engine operating condition (e.g. load) has changed during the engine speed test, the engine speed may be measured a third time, a sufficient period of time after the air/fuel ratio is changed during an engine speed test to allow the engine to recover after the air/fuel ratio change. If the first engine speed (taken before the fuel mixture change) and the third engine speed (taken after the fuel mixture change and after a recovery period) are significantly different, this may indicate a change in engine load occurred during the test cycle. In that situation, the engine speed change may not have been solely due to the fuel mixture change enleanment) during the engine speed test. That test data may either be ignored (i.e. not used in further calculation) or a correction factor may be applied to account for the changed engine condition and ensure a more accurate air/fuel ratio determination.

In one form, and as noted above, the mixture control device that is used to change the air/fuel ratio as noted above includes a valve 8 that interrupts or inhibits a fluid flow within the carburetor 4. In at least one implementation, the valve 8 affects a liquid fuel flow to reduce the fuel flow rate from the carburetor 4 and thereby enlean the fuel and air mixture delivered from the carburetor to the engine. The valve may be electrically controlled and actuated. An example of such a valve is a solenoid valve. The valve 8 may be reciprocated between open and closed positions when the solenoid is actuated. In one form, the valve prevents or at least inhibits fuel flow through a passage 120 (FIG. 1) when the valve is closed, and permits fuel flow through the passage when the valve is opened. As shown, the valve 8 is located to control flow through a portion of the fuel circuit that is downstream of the fuel metering assembly and upstream of a main fuel jet that leads into the fuel and air mixing passage. Of course, the valve 8 may be associated with a different portion of the fuel circuit, if desired. By opening or closing the valve 8, the flow rate of fuel to the main fuel jet is altered (i.e. reduced when the valve is closed) as is the air/filet ratio of a fuel mixture delivered from the carburetor. A rotary throttle valve carburetor, while not required, may be easily employed because all fuel may be provided to the fuel and air mixing passage from a single fuel circuit, although other carburetors may be used.

In some engine systems, an ignition circuit 38 may provide the power necessary to actuate the solenoid valve 8. A controller 60 associated with or part of the ignition circuit 38 may also be used to actuate the solenoid valve 8, although a separate controller may be used. As shown in FIG. 3, the ignition circuit 38 may include a solenoid driver sub-circuit 130 communicated with pin 3 of the controller 60 and with the solenoid at a node or connector 132. The controller may be a programmable device and may have various tables, charts or other instructions accessible to it (e.g. stored in memory accessible by the controller) upon which certain functions of the controller are based.

The timing of the solenoid valve, when it is energized during the portion of the time when fuel is flowing into the fuel and air mixing passage, may be controlled as a calibrated state in order to determine the normal air/fuel ratio curve. To reduce power consumption by the solenoid, the fuel mixture control process may be implemented (that is, the solenoid may be actuated) during the later portion of the time when fuel flows to the fuel and air mixing passage (and fuel generally flows to the filet metering chamber during the engine intake stroke). This reduces the duration that the solenoid must be energized to achieve a desired enleanment. Within a given window, energizing the solenoid earlier within the fuel flow time results in greater enleanment and energizing the solenoid later results in less enleanment. In one example of an enleanment test, the solenoid may be energized during a brief number of revolutions, such as 30. The resultant engine speed would be measured around the end of this 30 revolution enleanment period, and thereafter compared with the engine speed before the enleanment period.

With a 4-stroke engine, the solenoid actuated enleanment may occur every other engine revolution or only during the intake stroke. This same concept of operating the solenoid every other revolution could work on a 2-stroke engine with the main difference being the solenoid energized time would increase slightly. At slower engine speeds on a 2-stroke engine the solenoid control could then switch to every revolution which may improve both engine performance and system accuracy.

It is also believed possible to utilize the system to provide a richer air/fuel mixture to support engine acceleration. This may be accomplished by altering the ignition timing (e.g. advancing ignition timing) and/or by reducing the duration that the solenoid is energized so that less enleanment, and hence a richer fuel mixture, is provided. When the initial carburetor calibration is rich (e.g. approximately 20-25% rich), no solenoid actuation or less solenoid actuation will result in a richer fuel mixture being delivered to the engine. Further, if the amount of acceleration or acceleration rate can be sensed or determined, a desired enrichment amount could be mapped or determined based on the acceleration rate. Combining both the ignition timing advance and the fuel enrichment during transient conditions, both acceleration and deceleration can be controlled for improved engine performance. Ignition timing may be controlled, in at least some implementations, as disclosed in U.S. Pat. No. 7,000,595, the disclosure of which is incorporated by reference herein, in its entirety.

Idle engine speed can be controlled using ignition spark timing. While not wishing to be held to any particular theory, it is currently believed that using a similar concept, fuel control could be used to improve the idle engine speed control and stability. This could be particularly useful during the end of transient engine conditions such as come-down. The combination of ignition and fuel control during idle could improve engine performance.

Finally, when the basic carburetor calibration is rich (for example, but not limited to, 20-25% rich), it is possible to use a combination of a thermistor in an ignition module and a run clock event, such as revolutions from start up or a straight running clock time, to determine a desired enrichment amount to provide to facilitate engine warm-up and improve the stability of engine operation during warm-up.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A process of controlling a fuel and air mixture supplied to an operating engine with an electronic controller with a memory comprising the steps of:

a) determining a first engine speed before enleaning the fuel and air mixture supplied to the engine for a first number of engine revolutions;

b) enleaning the fuel and air mixture delivered to the engine for a second number of engine revolutions;

c) determining a second engine speed for a third number of engine revolutions near, at or just after the end of the second number of engine revolutions;

d) after ending the enleaning and after a recovery period, determining a third engine speed;

e) if the third engine speed and the first engine speed are not significantly different, determining the difference between the first engine speed and the second engine speed;

f) if such speed difference is less than a minimum speed threshold enleaning the fuel and air mixture or if such speed difference is greater than a maximum speed threshold enriching the fuel and air mixture;

g) repeating steps a) through f) at least until the difference between the first and second engine speeds is within the thresholds; and h) repeating steps a) through g) multiple times during a period of engine operation.

2. The process of claim 1 wherein to be used in a determination to enlean the fuel and air mixture, the difference between the first engine speed and second engine speed may be greater than the minimum threshold speed.

3. The process of claim 1 wherein to be used in a determination for a change in air/fuel ratio, the difference between the first engine speed and third engine speed must be less than a maximum threshold speed.

4. The process of claim 1 wherein to be used in a determination to enlean the fuel and air mixture, the difference between the first engine speed and second engine speed may be between the minimum threshold and the maximum threshold speeds.

5. The process of claim 1 wherein the minimum threshold speed is less than 50 rpm.

6. The process of claim 5 wherein the maximum threshold speed is at least 500 rpm.

7. The process of claim 1 wherein an engine speed test of steps a) though e) is run multiple times, the difference between the first engine speed and second engine speed is determined for each engine speed test complying with step e) and the determination of whether a change in air/fuel ratio is needed occurs after at least two of such engine speed tests complying with step e) yield a difference between the first engine speed and second engine speed that is less than the minimum threshold speed or greater than the maximum threshold speed.

8. The process of claim 7 wherein to be used in a determination to enlean the air/fuel ratio, the difference between the first engine speed and second engine speed may be greater than the minimum threshold speed.

9. The process of claim 7 wherein to be used in a determination for a change in air/fuel ratio, the difference between the first engine speed and third engine speed must be less than a maximum threshold.

10. The process of claim 7 wherein to be used in a determination to enlean the air/fuel ratio, the difference between the first engine speed and second engine speed may be between the minimum threshold and the maximum threshold.

11. The process of claim 7 which also includes providing a carburetor which provides the fuel mixture to the engine, said carburetor initially set to deliver to the engine a richer fuel mixture than the engine requires for normal operation, and wherein the step of changing the air/fuel ratio of the fuel mixture is initially accomplished by enleaning the fuel mixture delivered to the engine by the carburetor.

12. The process of claim 11 wherein the carburetor includes a mixture control device and the fuel mixture is enleaned by actuating the mixture control device.

13. The process of claim 12 wherein the mixture control device includes a solenoid valve that, when actuated, inhibits a fuel flow within the carburetor.

14. The process of claim 1 which also includes providing a carburetor which provides the fuel mixture to the engine, said carburetor initially set to deliver to the engine a richer fuel mixture than the engine requires for normal operation, and wherein the step of changing the air/fuel ratio of the fuel mixture is initially accomplished by enleaning the fuel mixture delivered to the engine by the carburetor.

15. The process of claim 14 wherein the carburetor includes a mixture control device and the fuel mixture is enleaned by actuating the mixture control device.

16. The process of claim 15 wherein the mixture control device is actuated for a predetermined period of time to cause a predetermined change to the air/fuel ratio of the fuel mixture.

17. The process of claim 16 wherein the predetermined period of time is between 1 and 150 engine revolutions.

18. The process of claim 16 wherein the mixture control device is actuated for only a portion of each engine revolution that occurs during said predetermined period of time.

19. The process of claim 15 wherein the mixture control device includes a solenoid valve that, when actuated, inhibits a fuel flow within the carburetor.

20. The process of claim 1 wherein the difference between the first engine speed and the second engine speed is determined using at least two rolling average values.

21. The process of claim 1 wherein the third engine speed is determined at a time different than the times at which the first engine speed and second engine speed were determined, and comparing the difference between the third engine speed and the first engine speed to a threshold speed to determine if they are not significantly different.

22. The process of claim 1 wherein the timing of an ignition event is also altered at least in part as a function of the difference between the first engine speed and the second engine speed.

23. The process of claim 1 wherein an engine speed test of steps a) though e) is run at least five times, the difference between the first engine speed and second engine speed is determined for each of five engine speed tests complying with step e) and the air/fuel ratio is not changed if three of such five complying engine speed tests yield a difference between the first engine speed and second engine speed that is between the minimum and maximum thresholds.

24. The process of claim 1 wherein the first number of engine revolutions is 4 to 6 revolutions.

25. The process of claim 1 wherein the fuel and air mixture is enleaned for 1 to 150 engine revolutions.

26. The process of claim 1 wherein the fuel and air mixture is enleaned for at least 30 engine revolutions.

27. The process of claim 1 wherein at least five engine speed tests of steps a) through e) are performed and at least three of five tests complying with step e) must meet the thresholds before step f) is performed of changing the ratio of the fuel and air mixture.

28. The process of claim 1 wherein the fuel and air mixture is initially richer than desired.

29. The process of claim 1 wherein the fuel and air mixture is initially up to 30% richer than desired.

30. The process of claim 1 wherein the fuel and air mixture is initially 20% to 25% richer than desired.

* * * * *